United States Patent [19]

Hanau et al.

[11] Patent Number: 4,939,673

[45] Date of Patent: Jul. 3, 1990

[54] METHOD AND APPARATUS FOR ENHANCEMENT OF DISPLAY SCREEN RESOLUTION

[75] Inventors: Paul R. Hanau, Portland, Oreg.; M. David Blythe, Colorado Springs, Colo.

[73] Assignee: Hewlett-Packard Company, Palo Alto, Calif.

[21] Appl. No.: 363,317

[22] Filed: Jun. 7, 1989

Related U.S. Application Data

[63] Continuation of Ser. No. 889,035, Jul. 22, 1986, abandoned.

[51] Int. Cl.[5] ..... G09G 1/10

[52] U.S. Cl. ..... 364/521; 340/739; 364/518; 382/44

[58] Field of Search ..... 364/518–522; 358/37, 64; 382/27, 44, 45; 340/732, 739, 724

[56] References Cited

U.S. PATENT DOCUMENTS

| | | | |
|---|---|---|---|
| 4,644,582 | 2/1987 | Morishita et al. | 352/44 X |
| 4,661,987 | 4/1987 | Anderson et al. | 382/44 X |
| 4,672,370 | 6/1987 | Yu | 340/739 |
| 4,720,705 | 1/1988 | Gupta et al. | 340/724 |

OTHER PUBLICATIONS

Hasebe, Kunio, Mason, William R. and Zamborelli, Thomas J., "A Fast, Compact, High-Quality Digital Display for Instruction Applications", Hewlett-Packard Journal, Jan. 1982, vol. 33, No. 1, pp. 20–28.

Robertson, Barbara, "Film Recorders for All Reasons", Computer Graphics World, Feb. 1986, pp. 45–52.

Wurtz, Jim, "The Evolution of CRT Color Film Recording Technology", Computer Graphics World, Feb. 1985, pp. 25–29, pp. 32, 34 and 96.

Dunn, James F., "A High Resolution Moderate Cost Film Recorder System for Color Graphics", presented at The Proceedings of the National Electronics Conference, vol. XXXIV in Chicago, Illinois on Oct. 27, 28 and 29, 1980, pp. 510–513.

*Primary Examiner*—Gary V. Harkcom
*Assistant Examiner*—H. R. Herndon
*Attorney, Agent, or Firm*—Christopher J. Byrne; Douglas A. Kundrat

[57] ABSTRACT

A method and apparatus for enhanced line endpoint positioning in an analog vector display, for use in high resolution color film recording and other high resolution imaging processes associated with computer generated graphics.

1 Claim, 13 Drawing Sheets

| (PXA, PYA) | (PXB, PYB) |
|---|---|
| (0,0) | (5,2) |
| (0,0) | (5,2) |
| (0,0) | (5,2) |
| (0,0) | (6,2) |
| (0,0) | (6,2) |
| (1,0) | (6,2) |
| (1,0) | (6,2) |
| (1,0) | (6,3) |

| VXA, STEP 520 | PXA, STEP 530 | RESULT, STEP 540 | VXA, STEP 550 | CTR, STEP 550 |
|---|---|---|---|---|
| 3:00000011 | 0:00000000 | 0 | 4 | 7 |
| 4:00000100 | 0:00000000 | 0 | 5 | 6 |
| 5:00000101 | 0:00000000 | 0 | 6 | 5 |
| 6:00000110 | 0:00000000 | 0 | 7 | 4 |
| 7:00000111 | 0:00000000 | 0 | 8 | 3 |
| 8:00001000 | 1:00000001 | 1 | 9 | 2 |
| 9:00001001 | 1:00000001 | 1 | 10 | 1 |
| 10:00001010 | 1:00000001 | 1 | 11 | 0 |

FIG 13A

| VYA, STEP 520 | PYA, STEP 530 | RESULT, STEP 540 | VYA, STEP 550 | CTR, STEP 550 |
|---|---|---|---|---|
| 0:00000000 | 0:00000000 | 0 | 1 | 7 |
| 1:00000001 | 0:00000000 | 0 | 2 | 6 |
| 2:00000010 | 0:00000000 | 0 | 3 | 5 |
| 3:00000011 | 0:00000000 | 0 | 4 | 4 |
| 4:00000100 | 0:00000000 | 0 | 5 | 3 |
| 5:00000101 | 0:00000000 | 0 | 6 | 2 |
| 6:00000110 | 0:00000000 | 0 | 7 | 1 |
| 7:00000111 | 0:00000000 | 0 | 8 | 0 |

FIG 13B

| VXB, STEP 520 | PXB, STEP 530 | RESULT, STEP 540 | VXB, STEP 550 | CTR, STEP 550 |
|---|---|---|---|---|
| 45:00101101 | 5:00000101 | 5 | 46 | 7 |
| 46:00101110 | 5:00000101 | 5 | 47 | 6 |
| 47:00101111 | 5:00000101 | 5 | 48 | 5 |
| 48:00110000 | 6:00000110 | 6 | 49 | 4 |
| 49:00110001 | 6:00000110 | 6 | 50 | 3 |
| 50:00110010 | 6:00000110 | 6 | 51 | 2 |
| 51:00110011 | 6:00000110 | 6 | 52 | 1 |
| 52:00110100 | 6:00000110 | 6 | 53 | 0 |

FIG 13C

| VYB, STEP 520 | PYB, STEP 530 | RESULT, STEP 540 | VYB, STEP 550 | CTR, STEP 550 |
|---|---|---|---|---|
| 17:00010001 | 2:00000010 | 2 | 18 | 7 |
| 18:00010010 | 2:00000010 | 2 | 19 | 6 |
| 19:00010011 | 2:00000010 | 2 | 20 | 5 |
| 20:00010100 | 2:00000010 | 2 | 21 | 4 |
| 21:00010101 | 2:00000010 | 2 | 22 | 3 |
| 22:00010110 | 2:00000010 | 2 | 23 | 2 |
| 23:00010111 | 2:00000010 | 2 | 24 | 1 |
| 24:00011000 | 3:00000011 | 3 | 25 | 0 |

FIG 13D

METHOD AND APPARATUS FOR ENHANCEMENT OF DISPLAY SCREEN RESOLUTION

CROSS REFERENCE TO RELATED APPLICATION

This application is a continuation of application Ser. No. 889,035, filed July 22, 1986, now abandoned.

BACKGROUND OF THE INVENTION

A color film recorder is used to convert computer generated graphics, typically viewed on a cathode ray tube (CRT) display screen, into photographic slides and prints. The computer generated image is first displayed on a CRT display screen within the recorder and the image is then captured on film. The quality and resolution of the final slide or print depends critically upon the resolution with which images are formed on the CRT.

The modern CRT display screen may be modeled with a two dimensional N×N grid such that resolution is directly related to the density of the grid. The prior art offers two types of CRT display screens, raster displays and analog vector displays. In raster displays, the display screen consists of a fixed grid of pixels and images are formed by selective illumination of individual pixels. Typically, the luminous intensity of each pixel may also be varied. In analog vector displays, the grid consists of addressable locations on a voltage grid. Such locations may be addressed with digital signals which are generated by a microprocessor and converted to voltage levels with digital-to-analog (D/A) converters. Images are formed by lines drawn with the smooth, continuous sweep of the CRT electron beam between locations on the voltage grid.

Although raster displays enjoy an increasing commercial dominance in CRTs, they do have an inherent drawback which is particularly harmful to image quality in film recorders. Since raster images consist of individual pixels, such images tend to exhibit jaggedness, particularly along lines which are nonparallel to the principal axes of the raster display. A partial solution to jaggedness is increased pixel density but such an increase requires costly additional hardware in the form of additional pixels and possibly additional control electronics. Alternatively, the appearance of jaggedness maybe reduced by using a technique known as raster anti-aliasing. Raster anti-aliasing involves balancing the intensity of the overall image by varying the intensity of individual pixels. The net effect is a partial smoothing of the jagged edges. This technique, however, is computationally very expensive in raster displays. Increasing the effectiveness of raster anti-aliasing may also involve a significant hardware cost, particularly in the electronics used to control pixel intensity. Unfortunately, the hardware costs of increased pixel density and the computational costs of raster anti-aliasing may become unacceptable at the resolution level necessary to produce high-quality film recording.

Analog vector displays do not have the inherent jaggedness problem of raster displays. In fact, since lines in the analog display are formed by the smooth, continuous sweep of the electron beam from one addressable location to another, such lines have essentially infinite resolution between endpoints. Therefore, resolution in analog vector displays depends solely upon how precisely the endpoints of lines may be positioned, that is, solely upon the density of the addressable locations in the voltage grid. Density of the voltage grid is a function of the size of the D/As which produce voltage levels. Each doubling of the grid density requires incrementing the bit length of the D/As. Unfortunately, the hardware costs become prohibitive at the higher grid densities required for quality film recording as larger D/As become expensive or unavailable.

SUMMARY OF THE INVENTION

In accordance with the illustrated preferred embodiment, the present invention provides an increased effective voltage grid density of an analog vector display without increased D/A costs. The denser effective voltage grid is referred to as the virtual grid. The physically addressable voltage grid, that is, the grid defined by the bit-length of the D/A hardware used, is referred to as the physical grid. Moreover, the word physical and the phrase physically addressable are interchangeable when used to modify the noun grid or to refer to grid locations and grid axes. Also, the word virtual and the phrase physically unaddressable are interchangeable when used to modify the nouns grid and subgrid or to refer to grid locations grid axes. The result is a CRT display capable of the arbitrarily high resolution required for quality film recording with the inherent advantages of analog versus raster displays and without the need for larger D/As. The present invention increases the effective density of the physical grid of an analog display by drawing multiple component lines whose intensities combine to produce a single composite line. The composite line has virtual endpoints which appear to be positioned at resolutions finer than the physically addressable grid would allow. In such analog resolution enhancement, numerous component lines are actually drawn and their intensities add to produce an observed composite line. The endpoints of the numerous component lines are positioned at the physically addressable grid locations. By positioning the endpoints at the proper physically addressable grid locations, the intensities of the endpoints and of the lines themselves merge in a predictable way. The observed single composite line has virtual endpoints which may be precisely positioned at an arbitrarily high resolution. The result is an analog vector display with inherently infinite line resolution and arbitrarily high resolution endpoint positioning capability.

Such enhanced resolution endpoint positioning eliminates image irregularities such as unsightly intensity changes in fill patterns whose frequency is not an exact multiple of the distance between physically addressable grid locations. It also eliminates other patterns such as concentric circles which would otherwise have spacing non-uniformities as each line rounds-off to the nearest physically addressable grid location. These problems are especially serious in film recorders which are software compatible with high resolution pen plotters. Moreover, in the present invention additional hardware is not required to produce an effectively denser grid since density is enhanced by the drawing of additional lines. Iterative looping through the line drawing sequence does not require a change in hardware.

BRIEF DESCRIPTION OF THE DRAWINGS

FIG. 8 shows a portion of the physically addressable CRT screen grid of FIG. 3 with a superimposed higher resolution virtual subgrid.

FIGS. 13A through 13E show, in tabular form, how the steps of FIG. 11 generate the component endpoint coordinates necessary to draw the component lines 445, 450, 460, and 465 of FIG. 10.

DETAILED DESCRIPTION OF THE PREFERRED EMBODIMENT

Figure 1:
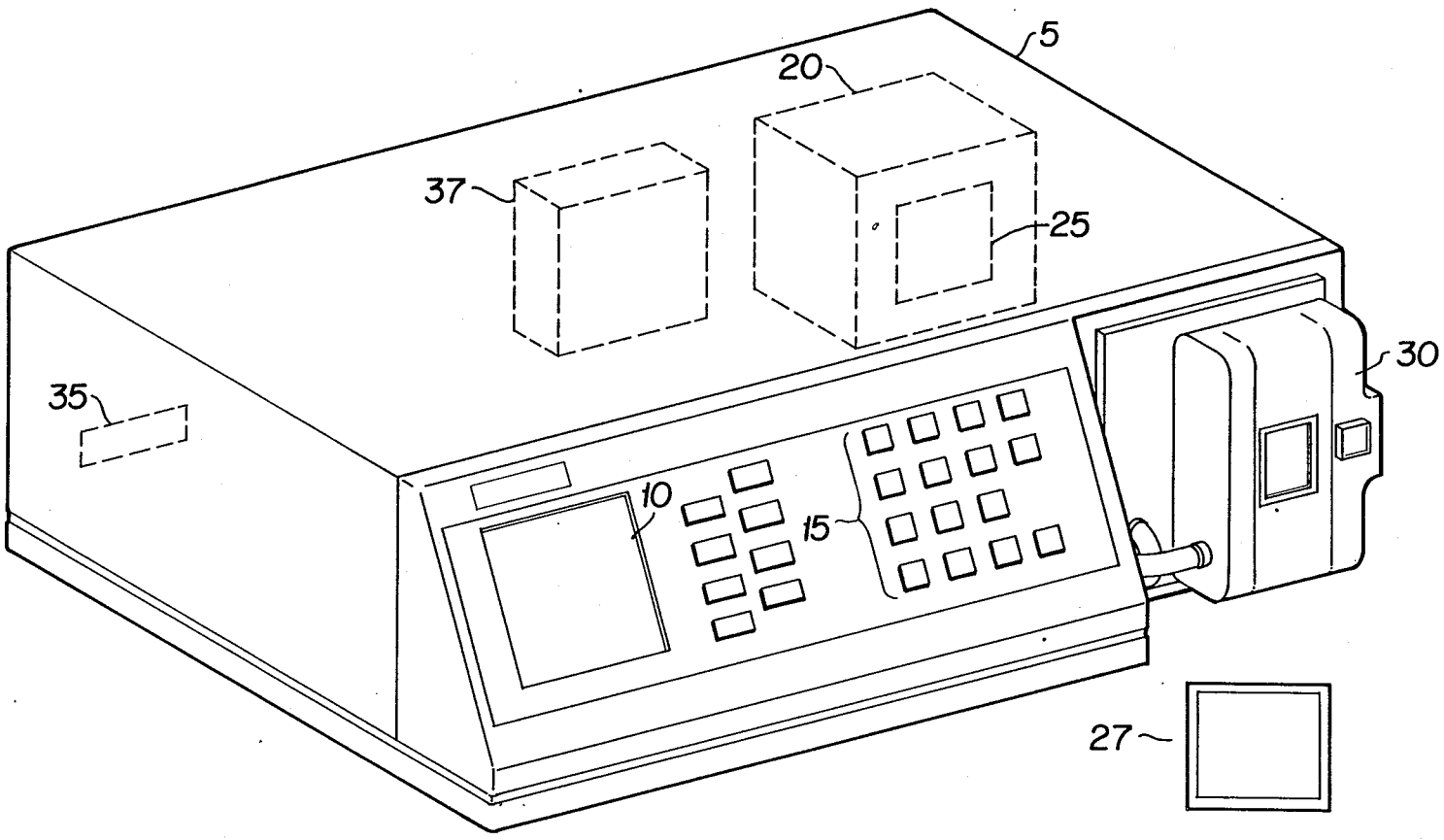
FIG. 1 shows an overview of a color film recorder which is constructed in accordance with the preferred embodiment of the present invention.

FIG. 1 shows an overview of a color film recorder 5 which is constructed in accordance with the preferred embodiment of the present invention. An external display screen 10 is used to display information to the user regarding operation of recorder 5. A menu keyboard 15 is used for control of recorder 5. A CRT 20 is housed inside recorder 5 and is hidden from user view. Display screen 25 of CRT 20 is used to display computer graphic images which are captured on film by a camera 30 to produce a photographic image 27. Port 35 accepts computer graphic signals and data, from external sources, to be processed by electronics 37 for display on screen 25.(It should be noted that the dimensions and shapes of the numerically referenced components of FIG. 1 may not match the actual physical dimensions and shapes of the components.)

Figure 2:
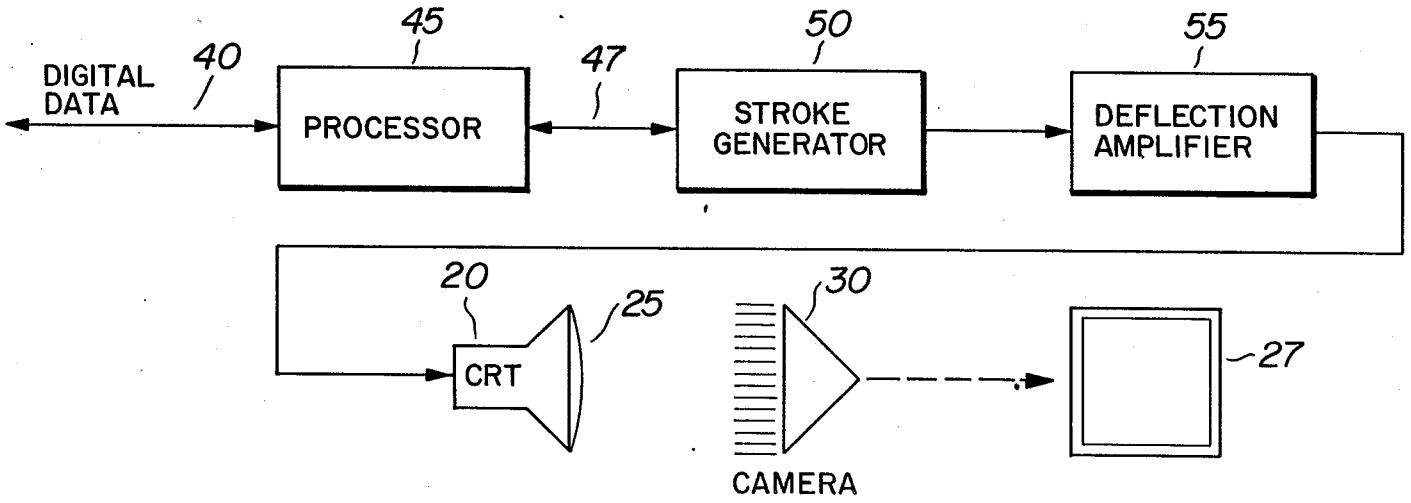
FIG. 2 is a general block diagram of the color film recorder of FIG. 1.

FIG. 2 is a general block diagram of the color film recorder 5. Digital data line 40 is used to pass digital data consisting of computer graphic information to processor 45. Processor 45 processes the information and passes the processed information on to stroke generator 50 via path 47. Stroke generator 50 produces signals which are passed to deflection amplifier 55 to result in images displayed on display screen 25 of CRT 20. Camera 30 captures the images on film to produce a photographic image 27. The recorder 5 incorporates many of the components used in the Hewlett-Packard Company model HP 1345A Digital Display Module and discussed in the Hewlett-Packard Journal, Volume 33, page 20, January 1982.

Figure 3:
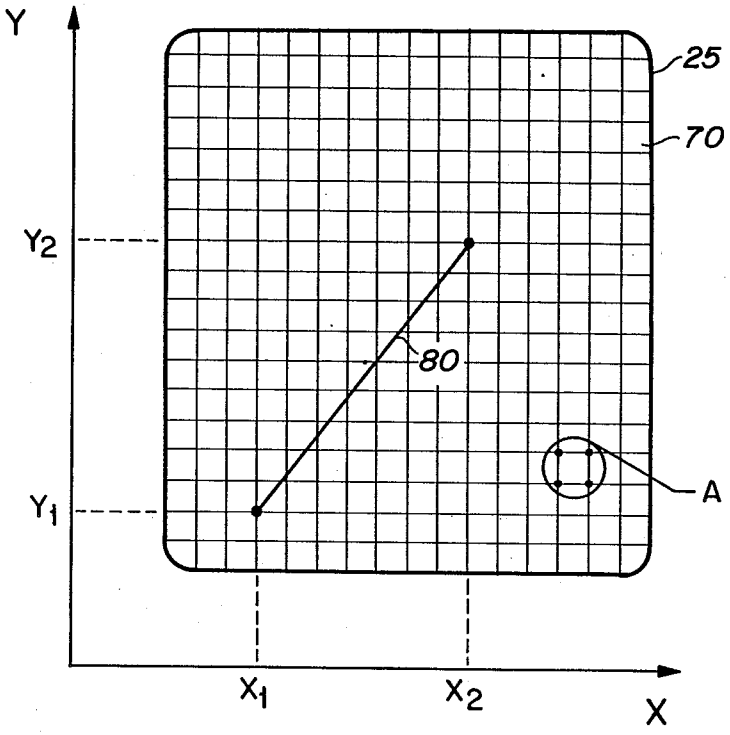
FIG. 3 shows a two dimensional physical grid superimposed on the CRT screen of FIG. 2.

FIG. 3 shows a frontal view of display screen 25 of CRT 20 with a superimposed two dimensional physical grid 70. The intersection points of physical grid 70 represent the physically addressable locations of display screen 25. Grid 70 may be resolved into an X—Y coordinate system such that any line having endpoints on physically addressable locations may be defined with the coordinates of its two endpoints, such as line 80 having endpoints ($x_1$, $y_1$) and ($x_2$, $y_2$). Grid 70 as it appears in FIG. 3 is scaled for visibility to the viewer of FIG. 3. In the preferred embodiment of the present invention, display screen 25, the physically addressable grid 70 is 2048×2048 locations dense, that is, the grid is a function of 11-bit D/As, and each location is randomly addressable. Moreover, the grid 70 is not visible itself since it is a voltage grid which is physically addressable with the D/As in both the X and Y directions. A line may be drawn on the display screen 25 by defining, via D/A addressing two locations on grid 70. The CRT 20 electron beam will sweep in a smooth, continuous fashion from one locations to the other making a uniformly bright line having infinite resolution between endpoints. Circle A highlights a small portion of the physically addressable grid 70 of FIG. 3 which is further detailed in FIG. 8, below.

Figure 4:
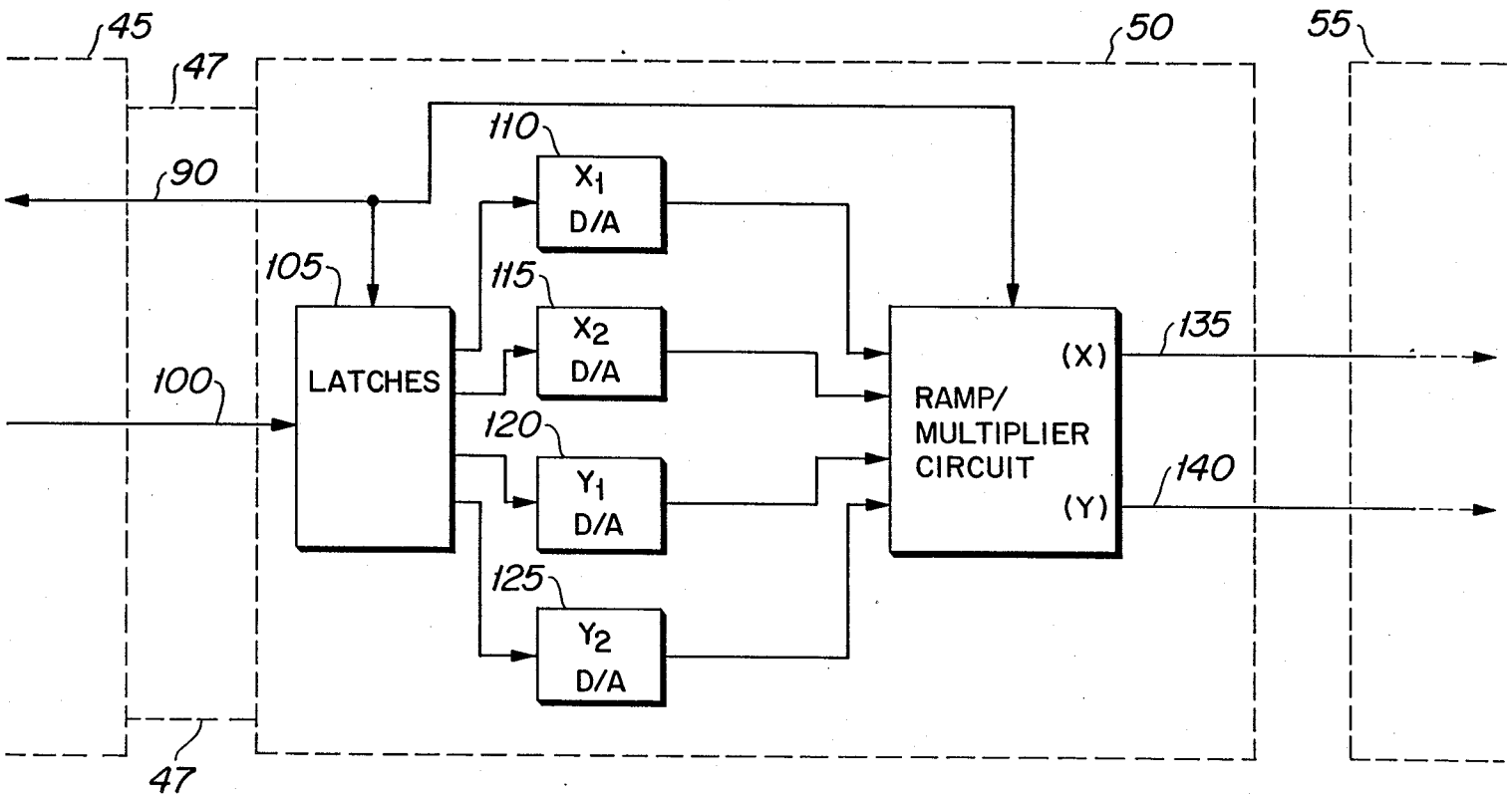
FIG. 4 is a functional block diagram of the color film recorder shown in FIG. 1.

FIG. 4 shows a detailed functional diagram of stroke generator 50, processor 45 and deflection amplifier 55 of FIG. 2. A control path 90 and a data path 100 are part of the path 47. The processor 45 communicates with stroke generator 50 via sixteen-bit digital words. A single sixteen bit word contains information for a single coordinate of grid 70 where two coordinates, such as ($x_1$, $y_1$), for example, are required to define a single addressable location on the grid 70 and two addressable locations, ($x_1$, $y_1$) and ($x_2$, $y_2$) are required to define a line. Hence, four grid 70 coordinates, that is, four sixteen bit digital words, are required to produce a single line. Twelve of the sixteen bits are reserved for grid 70 coordinate information, that is, the address of an addressable location. However, since only eleven bits are needed by the D/As to define a single coordinate, the twelfth bit is unused. The four remaining bits of each sixteen bit word are control bits.

The processor 45 defines a line, such as line 80 of FIG. 3, by passing four sixteen bit digital words to stroke generator 50, one word at a time. The first two words define the starting location of the line, such as ($x_1$, $y_1$), and the next two words define the stopping location of the line, such as ($x_2$, $y_2$) For each sixteen bit word, the twelve bits of grid 70 coordinate information travel along path 100 and the four bits of control information travel along path 90. Latches 105 channel the 12 coordinate bits of each word to one of D/As 110, 115, 120, 125. D/A 110 converts the eleven coordinate bits for coordinate $x_1$ into a voltage signal and D/A 120 converts the bits for coordinate $y_1$ into a voltage signal. D/As 115 and 125 perform the same conversion for coordinates $x_2$ and $y_2$. The voltage signals generated by D/As 110, 115, 120, 125 are passed to a voltage ramp generator and analog multiplier circuit 130.

Circuit 130 uses the voltage signals to direct the electron beam of CRT 20 between particular addressable locations on display screen 25. The voltage signals corresponding to the X coordinates are used by circuit 130 to drive the X axis of the grid 70 via deflection amplifier 55. The voltage signals corresponding to the Y coordinates are used by circuit 130 to drive the Y axis of the grid 70 via deflection amplifier 55.

Figure 5:
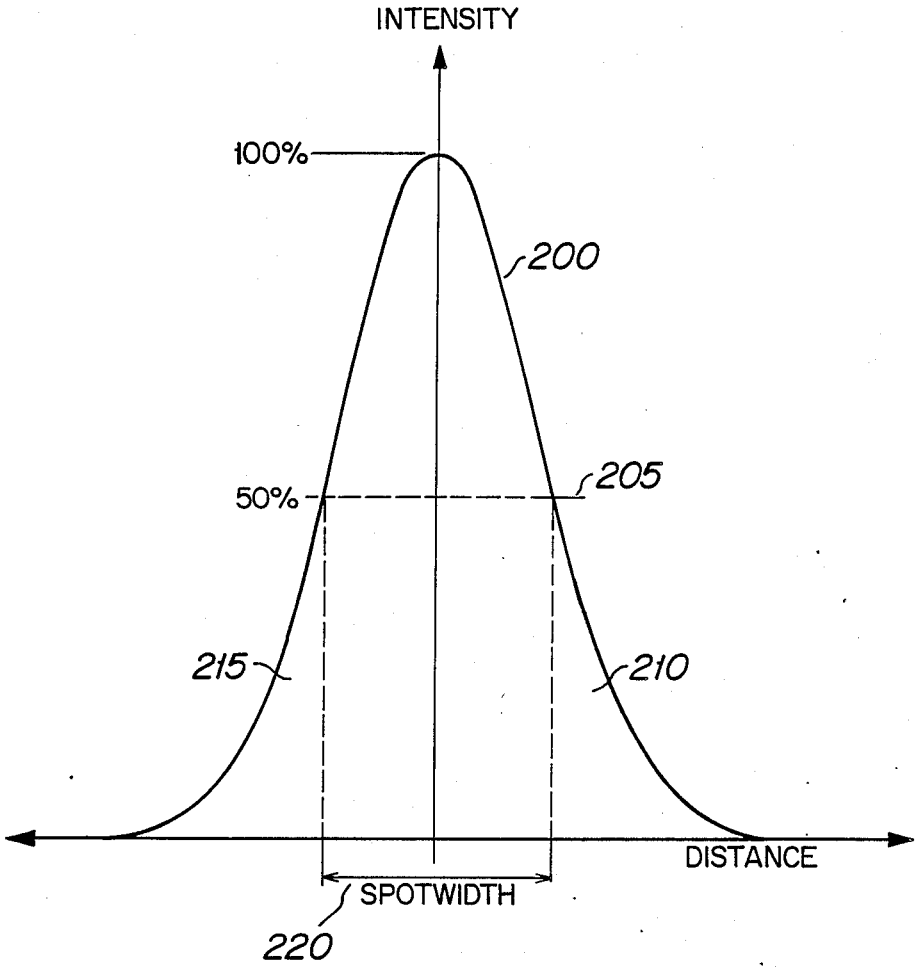
FIG. 5 shows a Gaussian light energy distribution curve for a single CRT electron beam spot.

FIG. 5 shows the Gaussian light energy distribution of a single circular "spot" of light, such as the "spot" caused by the electron beam of the CRT 20 on CRT display screen 25. Such a "spot" is best considered as the cross-section of a line which would be swept across CRT display screen 25 by the motion of the CRT 20 electron beam. The Gaussian distribution of FIG. 5 applies to an entire line, not just a single spot. A spot is discussed for ease of teaching. Curve 200 represents the luminous intensity of the spot as a function of distance from the center of the spot. A common definition of spotwidth is the diameter of the spot at fifty percent of maximum intensity. Line 205, which is drawn parallel to the distance axis, indicates the fifty percent point. The spotwidth 220 of the spot represented by curve 200 is the absolute value of the distance between lines 210 and 215 at fifty percent line 205.

Figure 6:
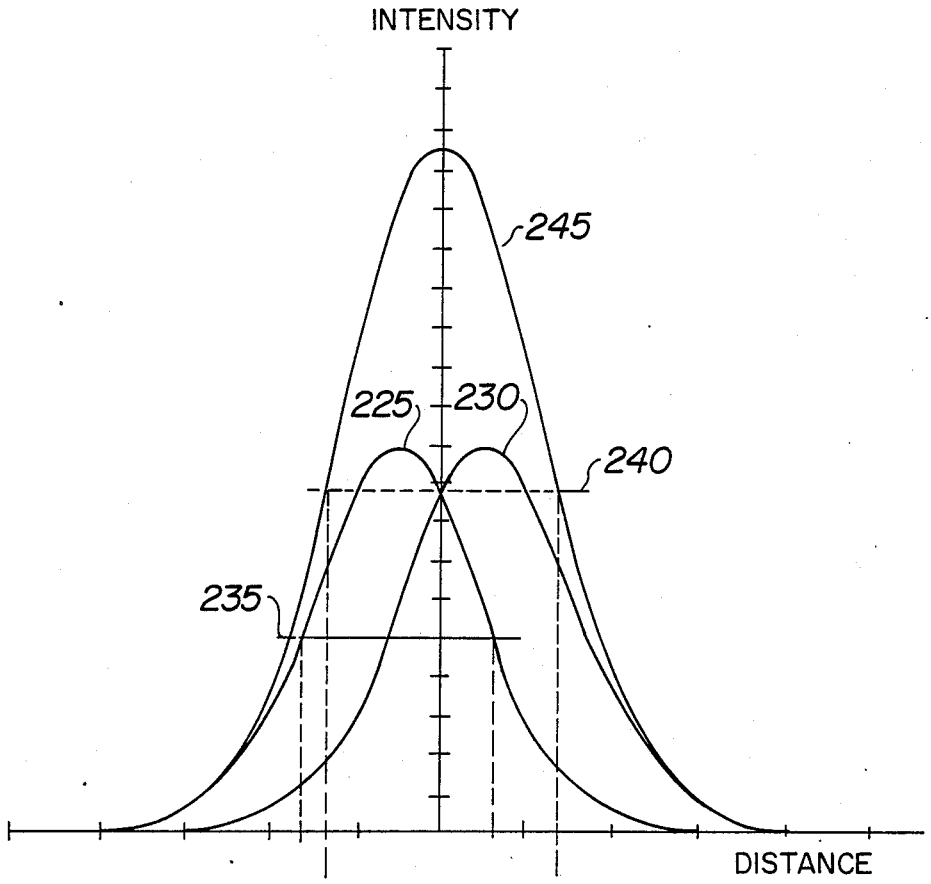
FIG. 6 shows the Gaussian light energy distribution of a composite spot formed from the Gaussian distributions of two component spots.

FIG. 6 shows the summing effect of two equal intensity spots having centers separated by the distance between two physically addressable locations on the 2048×2048 voltage grid 70. The distance between two physically addressable locations is referred to as an addressable unit. Curve 225 represents the Gaussian light energy distribution of one spot. Curve 230 represents the Gaussian light energy distribution of another spot of equal intensity whose center is one addressable unit away from the center of the first spot. Curve 245 represents the resultant light energy distribution resulting from the intensity summing effect of positioning two spot centers one addressable unit apart. Curve 245 is the light energy that would be perceptible to camera 30 of FIG. 1. Hence, the effect is that a composite spot, represented by curve 245, appears between the two component spots, which would no longer be separately perceptible. Line 235 represents the fifty percent point of curves 225 and 230. Line 240 represents the fifty percent point of the composite curve 245. The positioning of two equal intensity spots one addressable unit apart produces a composite spot at a physically unaddressable virtual location. Ordinarily, such a location would require twice the resolution of the physically addressable grid 70. Note also that the width of composite spot 245 at fifty percent line 240 is only slightly greater than the width of either component spot, 225 or 230, at fifty percent line 235.

Figure 7:
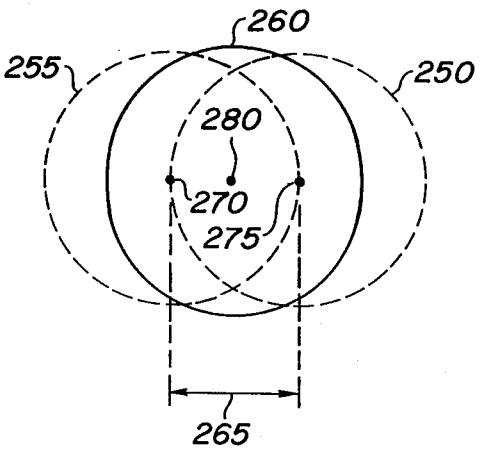
FIG. 7 shows the addition of two electron beam component spots to form a single composite spot.

FIG. 7 is a pictorial representation of the composite spot of FIG. 6. Spots 250 and 255 represent the component spots and spot 260 represents the resulting composite spot. Only the composite spot 260 would be perceptible by camera 30 of FIG. 1. Distance 265 represents one addressable unit on grid 70. Physically addressable location 270 is the center of component spot 255 and adjacent physically addressable location 275 is the center of component spot 250. Virtual location 280 is the center of composite spot 260 and is located halfway between physically addressable locations 270 and 275. Virtual location 280 is not physically addressable using the D/As which define the 2048×2048 grid 70 having physically addressable locations 270 and 275. In order to physically address virtual location 280, the grid 70 would require twice its present density. It should also be noted that the shape of composite spot 260 in FIG. 7 is idealized for the sake of teaching. The actual shape of spot 260 would be slightly more elliptical. Center 280, however, would remain the same.

Since the intensity summing effect shown in FIGS. 6 and 7 is cumulative, additional spots would result in additional enhanced virtual resolution. Although it is possible to enhance the virtual resolution level by any factor, it is most convenient to enhance levels by a factor of two since this only requires bit shifting to connect between physical and virtual address realms. Persons of ordinary skill in the art may easily apply the present invention to enhancement levels by factors other than two. An additional critical fact is that lines swept out by the motion of the electron beam of CRT 20 across display screen 25 will exhibit the same intensity summing effect such that composite lines with endpoints anchored at appropriate physically addressable locations will also merge intensities to produce a line with virtual endpoints.

Figures 8, 13E:
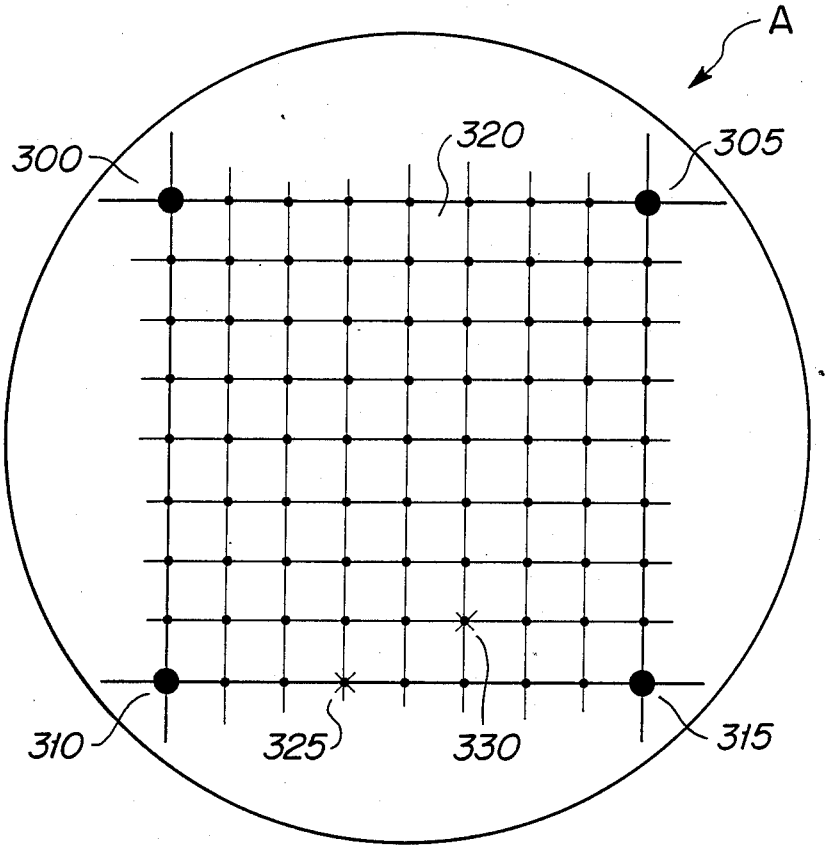

FIG. 8 is an exploded view of circle A of FIG. 3, showing physically addressable locations 300, 305, 310, 315 of voltage grid 70 which define a virtual subgrid 320 having sides one addressable unit in length. Virtual subgrid 320 has eight times the resolution of the physically addressable grid and, for physical addressing, would require three additional address bits. Using the virtual spot result shown in FIGS. 6 and 7, a composite spot may appear to be positioned at any of the virtual locations of subgrid 320. To do so, component spots must be positioned among physically addressable locations 300, 305, 310 and 315. Eight component spots are required because the resolution of subgrid 320 is eight times as fine as the resolution of the physically addressable grid 70. For example, positioning a composite spot at virtual location 325 would require five component spots at location 310 and three at physical location 315. Positioning a composite spot at virtual location 330 would require three component spots at physical location 310, four at physical location 315 and one at physical location 305. Similarly, composite spots may be positioned at any of the remaining virtual locations. Note that component spots may be superimposed so that one spot may be on top of another and still exhibit intensity summing effects. The combination of component physical locations discussed above is not a unique solution to positioning a composite virtual spot at virtual locations 325 and 330. Other combinations may work as well as long as the proper intensity balance is achieved.

Figure 9:
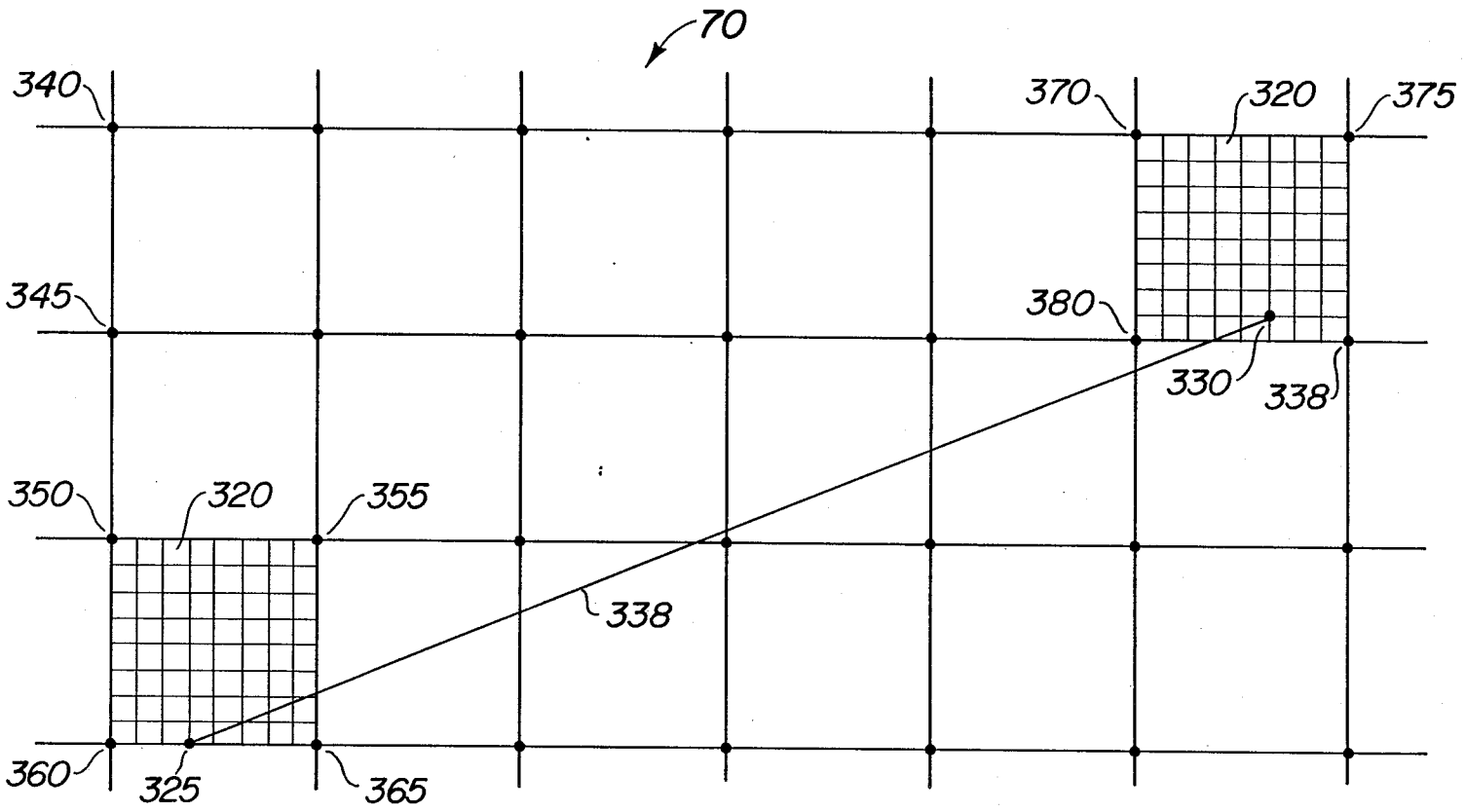
FIG. 9 shows the CRT screen grid of FIG. 3 with a high resolution composite line having endpoints positioned on the virtual subgrid shown in FIG. 8.

In FIG. 9, a portion of the physically addressable voltage grid 70 having physically addressable locations indicated with dots such as locations 340, 345, 350, 355, 360, 365, 370, 375, 380, and 385. Line 338 has a virtual endpoint 325 positioned on virtual subgrid 320 which has eight times the resolution of the physically addressable grid 70. Line 338 has another virtual endpoint 330 positioned on subgrid 320 superimposed at the other end of line 338. Line 338 can only be a composite line because its endpoints are virtual, that is, they are not physically addressable. The word composite is interchangeable with the word virtual. The word component is interchangeable with the word physical.

Figure 10:
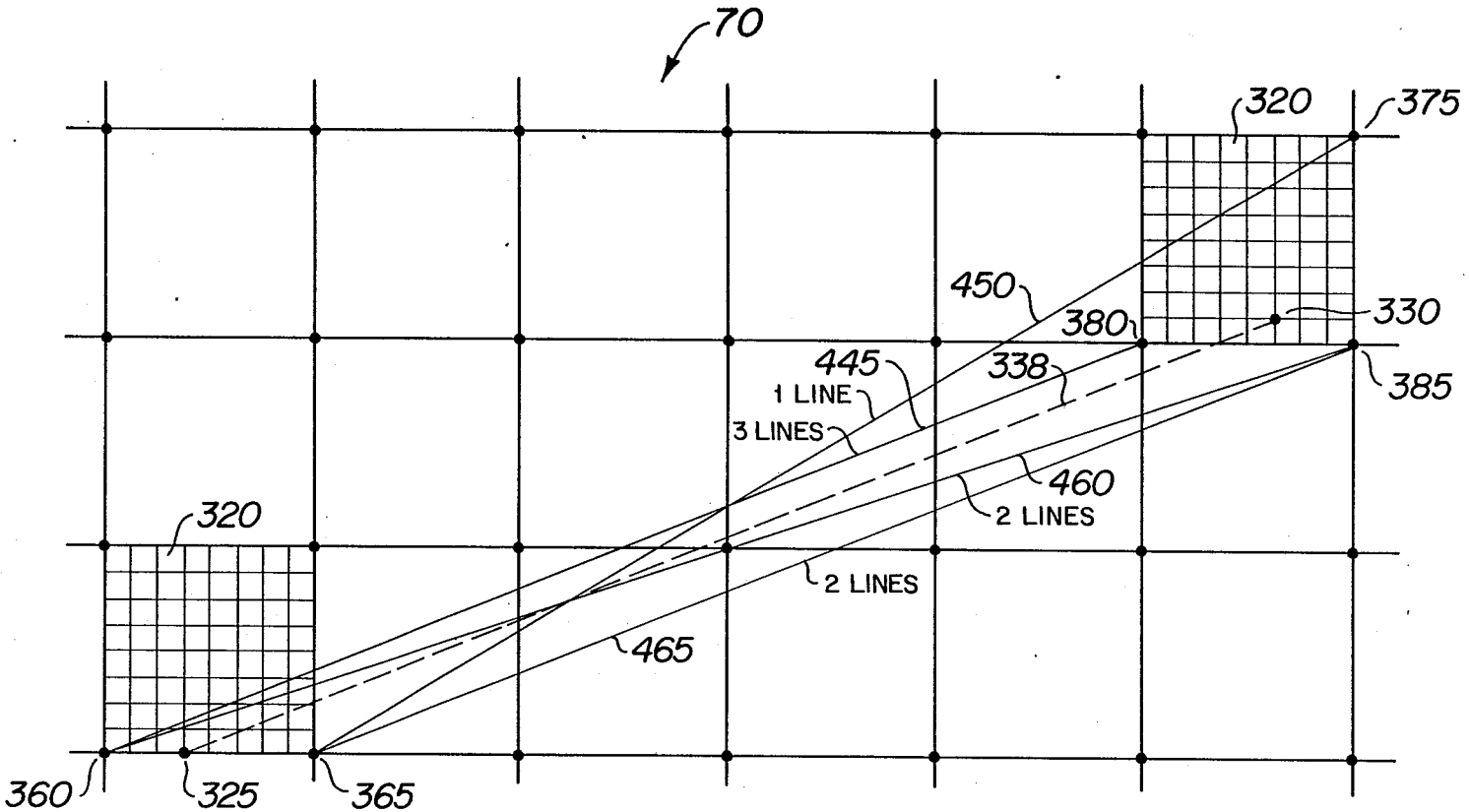
FIG. 10 shows the component lines of the composite line shown in FIG. 9.

FIG. 10 shows the component lines which are required to compose composite line 338 of FIG. 9. Composite line 338 of FIG. 9 is shown as dashed line 338 in FIG. 10. In FIG. 10, dashed line 338 has virtual endpoints 325 and 330 which are positioned, relative to subgrid 320 of FIG. 8, at virtual locations 325 and 330 respectively. Just as in FIG. 8 where composite spots were positioned at virtual locations 325 and 320, so too may composite line 338 have composite endpoints positioned at virtual locations 325 and 330 relative to subgrid 320. As can be seen in FIG. 10, composite line 338 is composed of eight component lines, each of which has endpoints positioned at physically addressable locations. Line 450 indicates one component line with endpoints positioned at physically addressable locations 365 and 375. Reference numeral 455 indicates three component lines, each with endpoints positioned at physically addressable locations 360 and 380. Reference numeral 460 indicates two component lines each with endpoints positioned at physically addressable locations 360 and 385. Reference numeral 465 indicates two component lines each with endpoints positioned at physically addressable locations 365 and 385. Therefore, composite line 338 has a virtual endpoint at virtual location 325 by anchoring five component lines at physically addressable location 360 and three component lines at physically addressable location 365. Likewise, the other end of composite line 338 is positioned at virtual location 330 by anchoring the other ends of three of the component lines at physically addressable location 380, anchoring the other end of one of the component lines at physically addressable location 375 and anchoring the other end of four of the component lines at physically addressable location 385.

Figure 11:
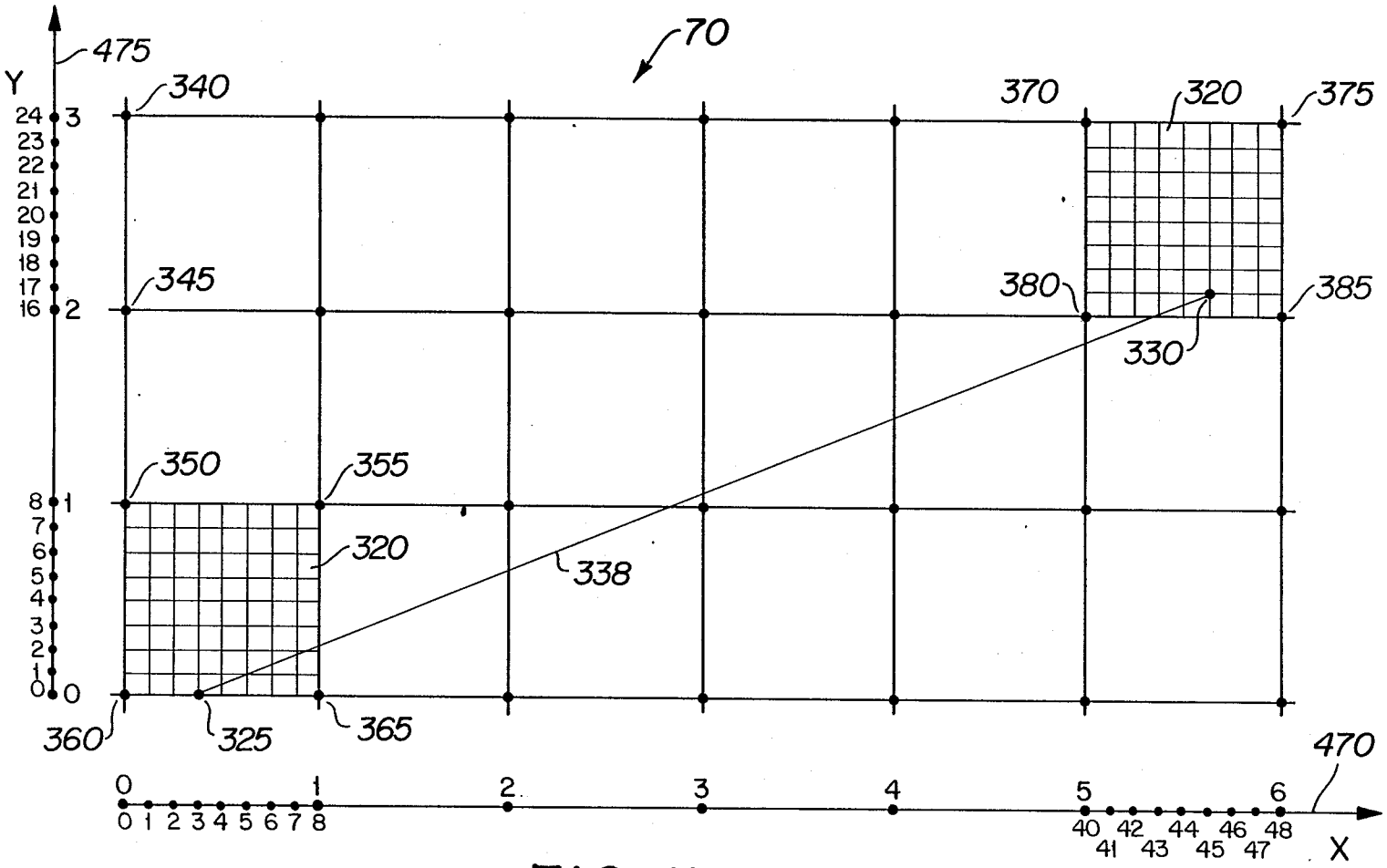
FIG. 11 shows FIG. 9 with the X and Y axes resolved into physically addressable and virtual addresses.

FIG. 11 shows grid 70 of FIG. 9 with X-axis 470 and Y-axis 475 superimposed. On the upper side of X-axis 470, the large numbers indicate the X-axis addresses of the physically addressable locations of grid 70. On the lower side of X-axis 470, the smaller numbers indicate the X-axis virtual addresses of the virtual locations of grid 320. Likewise, on the right hand side of Y-axis 475, the large numbers indicate the Y-axis addresses of the physically addressable locations of grid 70. The smaller numbers on the left hand side of Y-axis 475 indicate the Y-axis virtual addresses of the virtual locations of grid 320.

Figure 12:
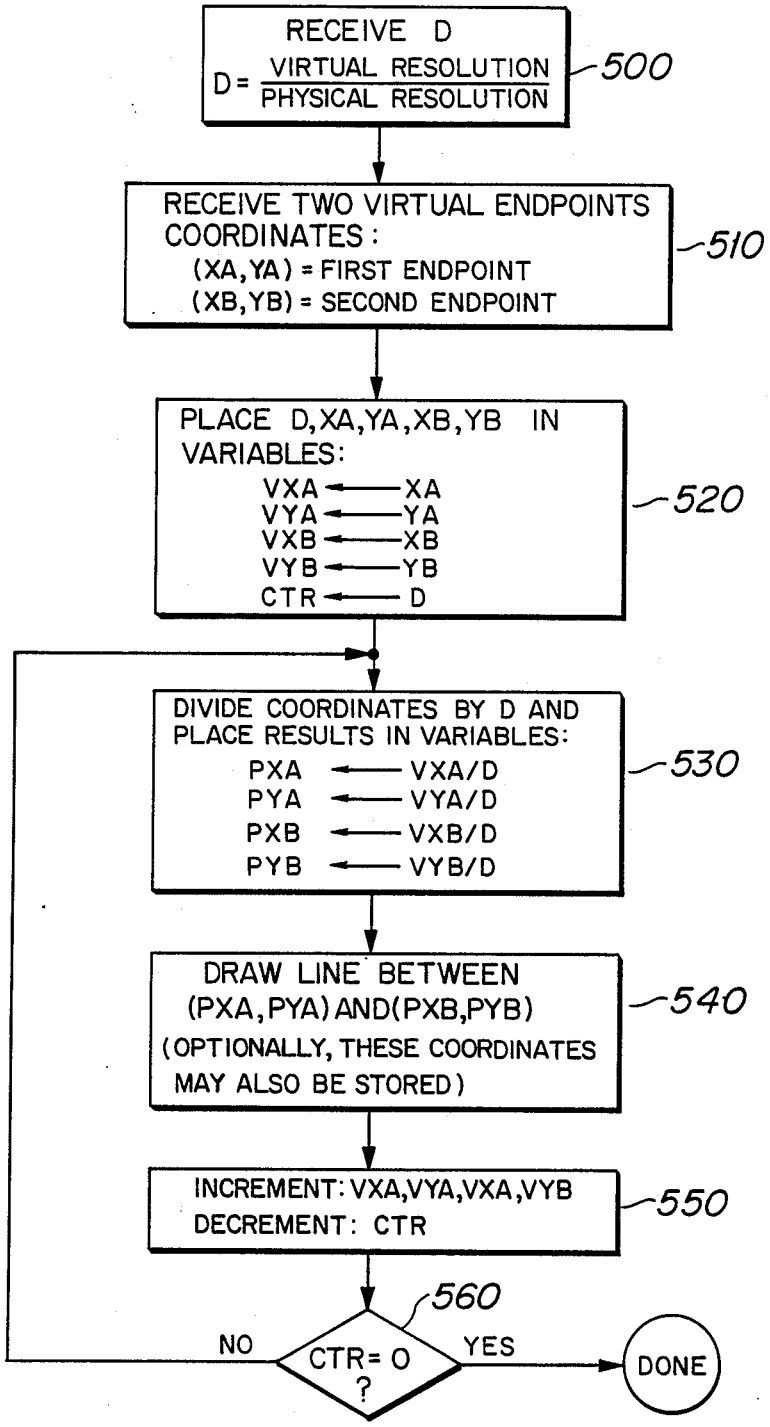
FIG. 12 shows the steps involved in composing the virtual line 338 of FIGS. 9, 10, and 11.

FIG. 12 shows the steps in the method for composing a virtual line 338 of FIGS. 9, 10 and 11 from component lines 450, 455, 460 and 465 of FIG. 10. The first step 500 is to determine D, the ratio of the density of the virtual grid resolution and the physically addressable grid resolution. The division of resolutions is performed using integer division with a discard of the remainder so that D is always rounded off to the next lowest whole number. For instance, dividing nineteen by two would result in a D of nine. The next step 510 is the reception of the two coordinates of the virtual endpoints of the desired composite line in the form of four variables: $(X_A, Y_A)$ and $(X_B, Y_B)$ $X_A$, $Y_A$, $X_B$ and $Y_B$ are each given in the form of a virtual address. In step 520, $X_A$, $Y_A$, $X_B$, and $Y_B$ into the variables $V_{XA}$, $V_{YA}$, $V_{XB}$ and $V_{YB}$, respectively and D is copied into variable CTR for looping counting purposes. In step 530, $V_{XA}$, $V_{YA}$, $V_{XB}$ and $V_{YB}$ are each divided by D. Again, division by D is integer division with a discard of the remainder and a rounding down to next lowest whole number. If D is a power of two, as is the case in the preferred embodiment of the present invention, then division by D can be accomplished quickly by right shifting the variables $\log_2 D$ bits to the right. The results of division by D are physical address locations $P_{XA}$, $P_{YB}$, $P_{XB}$ and $P_{YB}$ which provide the coordinates for physically addressable locations: $P_{XA}$, $P_{YA}$) and ($P_{XB}$, $P_{YB}$). The next step 540 is either the drawing of a line between the physically addressable coordinates of step 530 or the storage of the coordinates for later use, depending upon the demands of the user of the present invention. The next step 550 is the incrementing of virtual address variables $V_{XA}$, $V_{YA}$, $V_{XB}$, and $V_{YB}$ and the decrementing of CTR. In step 560 a decision is made: if CTR is zero then the physically addressable coordinates necessary to produce a virtual line have been determined, otherwise the steps of FIG. 12 are repeated beginning with step 530. Moreover, all the steps of FIG. 12 may be repeated any number of times to produce as many virtual lines as desired.

FIGS. 13A through 13E show the results of applying the steps of FIG. 12 to produce virtual line 338 of FIG. 11. As shown in FIG. 11, the virtual address coordinates of virtual endpoint 325 of virtual line 338 are $X_A=3$ and $Y_A=0$; likewise, the virtual address coordinates of virtual endpoint 330 of line 338 are $X_B=45$ and $Y_B=17$. Hence, for virtual line 338 of FIG. 11, $(X_A, Y_A)=(3, 2)$ and $(X_B, Y_B)=(45, 17)$. FIGS. 13A, 13B, 13C, and 13D show the results of applying the steps of FIG. 12 to $X_A$, $Y_A$, $X_B$, and $Y_B$ respectively, where $X_A$, $Y_A$, $X_B$ and $Y_B$ have the values discussed immediately above. The "Result, step 540" column of FIGS. 13A, 13B, 13C and 13D contains the resulting physically addressable component locations which will be combined to produce the physically addressable coordinates necessary to draw the D component lines which are required to compose the desired virtual line 338. As can be seen from FIG. 13E, the "Result, step 540" column of FIG. 13A contains the D $P_{XA}$ physically addressable addresses. The same column of FIG. 13B contains the D $P_{YA}$ physically addressable addresses. The same column of FIG. 13C contains the D $P_{XB}$ physically addressable addresses. The same column of FIG. 13D contains the D $P_{YB}$ physically addressable addresses. The net result, as seen in FIG. 13E, are the physically addressable grid coordinates necessary to properly anchor D lines to produce the virtual line 338 of FIGS. 9, 10 and 11. In particular, the D component lines required are shown in FIG. 10 with reference numerals 445, 450, 460 and 465. It can be seen from a comparison of FIGS. 13E, and FIGS. 10 and 11, that FIG. 13E displays the physically addressable coordinates of the component lines 445, 450, 460 and 465 of FIG. 10.

We claim:

1. A method for increasing the visually perceptible resolution of a physically addressable analog-vector-display-screen coordinate system grid, said grid having a predetermined actual-resolution-density, until said resolution appears, to a viewer, to equal a greater predetermined virtual-resolution-density, and for drawings at least one composite line resolved at said virtual density, said method for increasing and drawing comprising the steps of:

(a) receiving a first endpoint virtual coordinate X,Y pair, said first virtual pair having a virtual resolution higher than the grid resolution;

(b) receiving a second endpoint virtual coordinate X,Y pair at the virtual resolution;

(c) determining D as the integer division of the virtual resolution by the grid resolution;

(d) creating a first anchor point X coordinate by dividing the first endpoint X coordinate by D using integer division;

(e) creating a first anchor point Y coordinate by dividing the first endpoint Y coordinate by D using integer division;

(f) creating a second anchor point X coordinate by dividing the second endpoint X coordinate by D using integer division;

(g) creating a second anchor point Y coordinate by dividing the second endpoint Y coordinate by D using integer division;

(h) drawing, on said analog vector display screen with an electron beam, a component line from the first anchor point to the second anchor point;

(i) incrementing the first endpoint coordinate X,Y pair;

(j) incrementing the second endpoint coordinate X,Y pair;

(k) repeating steps (d) through (j) until D component lines are drawn to form the composite line, such that the endpoints of the composite line visibly appear to be resolved at locations having said virtual density.

* * * * *